United States Patent [19]

Gerendas et al.

[11] 3,963,714

[45] June 15, 1976

[54] QUATERNARY AMMONIUM SALTS

[75] Inventors: Jozsef Gerendas, Neustadt; Herbert Fleischer, Beindersheim; Rolf Fikentscher, Ludwigshafen, all of Germany; Herbert Helfert, Trenton, Mich.

[73] Assignee: BASF Aktiengesellschaft, Ludwigshafen (Rhine), Germany

[22] Filed: Dec. 6, 1974

[21] Appl. No.: 530,305

[30] Foreign Application Priority Data

Dec. 13, 1973 Germany ..... 2361949

[52] U.S. Cl. ..... 260/249.6; 260/248 CS; 260/249.5; 260/249.8; 8/177 AB

[51] Int. Cl.[2] ..... C07D 251/70; C07D 251/52; C07D 251/46

[58] Field of Search ..... 260/248 CS, 249.5, 249.6, 260/249.8

[56] References Cited

UNITED STATES PATENTS

| | | | |
|---|---|---|---|
| 3,155,651 | 11/1964 | Gold | 260/248 |
| 3,265,690 | 8/1966 | Matter et al. | 260/248 |

*Primary Examiner*—John M. Ford
*Attorney, Agent, or Firm*—Johnston, Keil, Thompson & Shurtleff

[57] ABSTRACT

Special quaternary ammonium salts of 2,4,6-tris-(ω-dialkylamino-alkyleneamino)-triazines and 2,4,6-tris-(ω-dialkylaminoalkoxy)-triazines and their use in dyeing anionic polyacrylonitrile fibers with basic dyes; these special derivatives of triazine are particularly effective retarders.

11 Claims, No Drawings

QUATERNARY AMMONIUM SALTS

The invention relates to special quaternary ammonium salts, derived from 2,4,6-tris-(aminoalkylamino) derivatives of triazine, used as retarders in dyeing anionic polyacrylonitrile fibers with basic dyes.

When basic dyes are used to dye anionic polyacrylonitrile fibers in a long liquor, uneven dyeings result if there are temperature differences and/or concentration differences in the dyeing apparatus. Even the slightest differences suffice to produce this effect, since the rate at which cationic dyes are taken up is exceedingly temperature-dependent, Hitherto, various methods have been adopted in order to overcome this risk of producing uneven dyeings. These methods are:

1. Heating the dye liquor extremely slowly. The disadvantages of this are obvious, namely that the extra time required makes the process uneconomical, and that the method is unreliable.

2. Controlling the dyeing process and computing before-hand a temperature at which the goods are dyed at a defined rate of exhaustion of the bath (German Printed Application 1,619,376). This process is complex and requires specially trained operatives.

3. The use of levelling agents which improve levelling and only have a slight effect on build-up (German Patent 1,148,971). These are quaternary ammonium compounds without fatty alkyl radicals. They have the disadvantage of being rather ineffective where pale shades are concerned.

4. The use of so-called "retarders" which lower the rate of dyeing during the uptake phase. These are quaternary ammonium salts which contain at least one fatty alkyl radical of 8 to 22 carbon atoms (German Printed Application 1,090,171, 1,092,878 and 1,643,526). The effectiveness of previously disclosed retarders of this type is not entirely satisfactory, and above all they tend to block the tinctorially active centers of the fibers, which can cause problems in dyeing.

It is an object of the present invention to provide retarders which overcome the disadvantages of previously disclosed retarders.

This object is achieved by salts, containing quaternary ammonium groups, of the formula I

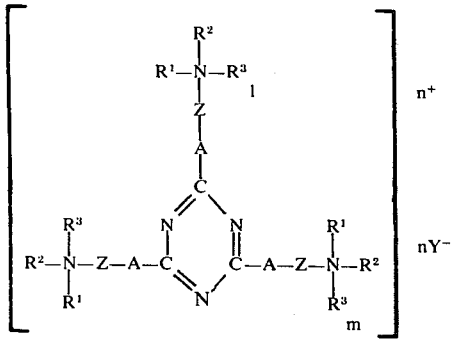

wherein A is an oxygen atom or an imino group —NR— in which R is H or alkyl of 1 to 4 carbon atoms, $R^1$, $R^2$ and $R^3$ independently of one another are straight-chain or branched alkyl of 1 to 30 carbon atoms which may be substituted by hydroxyl and/or interrupted by oxygen or nitrogen, or are alkyl of 1 to 4 carbon atoms in the alkyl chain, substituted by an aromatic substituent, or $R^1$ and $R^2$ together are alkylene of 4 to 6 carbon atoms, $l$ and $m$ independently of one another are 0 or 1, Z is alkylene of 2 to 6 carbon atoms in the chain, which may be substituted by hydroxyl or methyl and interrupted by oxygen, $Y^-$ is a monovalent organic or inorganic anion or is the $x$-th part of an $x$-valent organic or inorganic anion, $n$ equals the sum of $1 + l + m$ and the sum of the carbon atoms of all $R^1 + R^2 + R^3$ is 9 – 60 and the sum of the carbon atoms of $R^1 + R^2 + R^3$ of at least one ammonium group is not less than 5.

The compounds wherein Z is ethylene or 1,2-propylene and A is —NH— can be prepared, for example, by reacting cyanuric chloride, ethyleneimine or 1,2-propyleneimine and trialkylamines of 1 to 30 carbon atoms in each alkyl group, with one another in the molar ratio of 1:3:3 in an anhydrous medium and from 0° to 150°C, preferably from 50° to 120°C. If the trialkylamine is first reacted with epichlorohydrin, the resulting Z is hydroxyl-substituted pentamethylene.

A more universal method of preparation of the compounds of the formula I, wherein Z and A may have any of the defined meanings, is the reaction of the corresponding 2,4,6-tris-(ω-dialkylaminoalkyleneamino)-triazine or 2,4,6-tris-(ω-dialkylaminoalkoxy)-triazine with from 1 to 3 moles of an alkylating agent, such as dimethyl sulfate, diethyl sulfate, methyl chloride, benzyl chloride, chlorobenzyl chloride, lauryl chloride, stearyl chloride, alkyl halides with oxygen or nitrogen in the chain, etc., or alkylene oxides, in the presence of an acid, at elevated temperatures of up to 130°C, in the melt or in a polar solvent such as dimethylformamide or dioxane. If molar ratios below 1:3 are used, mixtures of the corresponding quaternary salts result and unconverted triazine starting material may remain. Mixtures are also obtained if different quaternizing agents are employed, simultaneously or successively. It is particularly advantageous to neutralize or slightly acidify the resulting quaternary salts I, of which the aqueous solutions can be slightly turbid to very turbid (depending on the alkylating agent and degree of alkylation), by addition of acids, for example, formic acid, which produces clear solutions which present no problems on dilution. In this method of preparation, the preferred bridges Z are again 1,2-ethylene, 1,2-propylene and also 1,3-propylene.

The 2,4,6-tris-(ω-dialkylamino-alkyleneamino)-triazines or dialkylamino-alkoxy-triazines to be quaternized are preferably prepared by reaction of cyanuric chloride with N,N-dialkylalkylenediamine or dialkylaminoalkenol (both of which may be oxyalkylated) at temperatures of from 30° to 100°C, in an anhydrous medium, for example benzene. This first results in the hydrochloride, from which the base can be liberated with caustic alkalis by conventional methods.

$R^1$ and $R^2$ in the formula I independently of one another contain from 1 to 30, preferably from 1 to 4, carbon atoms, and $R^3$ contains from 1 to 30, preferably from 10 to 18, carbon atoms. It is important that the compounds should contain at least one ammonium group and at least one long-chain nitrogen ligand per molecule. Tetramethylene, representing $R^1 + R^2$, is sufficiently long to qualify as a long-chain ligand. On the other hand the total number of carbon atoms of all nitrogen ligands $R^1$, $R^2$ and $R^3$ must not exceed 60 since the compounds would otherwise be too hydrophobic.

Preferred anions X are the bromide anion, and above all the chloride and the methosulfate anions. However, in principle any anions of acids of dissociation constant $>10^{-5}$ can be used. Iodide and formate may be mentioned as examples.

In addition to the quaternary ammonium compounds to be used in accordance with the invention, the bath may contain the conventional additives for dyeing with basic dyes, for example salts, such as sodium sulfate, sodium chloride or sodium acetate, or acids, such as acetic acid, or buffer solutions.

The quaternary ammonium compounds to be used can be in the form of pure compounds or preferably of technical mixtures. They can be used alone or in combination with suitable surfactants, such as surface-active products of the addition reaction of ethylene oxide with fatty amines or fatty alcohols or alkyl-phenols. The amount of the quaternary ammonium compounds to be used depends on the particular dyeing conditions, for example on the nature and amount of the basic dyes and the character and state of processing of the fibrous material to be dyed. It is from 0.003 to 5%, preferably from 0.02 to 0.4% of the weight of the goods, and may be added to the dyebath before dyeing or in the course of dyeing. An alternative is to pre-treat the fibrous material to be dyed may be in any desired form, for example in the form of loose fibers, yarn or fabric.

Anionic polyacrylonitrile fibers are to be understood as fibers of polyacrylonitrile and above all of acrylonitrile copolymers containing not less than 50, and preferably from 80 to 98, percent by weight of acrylonitrile and containing, as copolymerized units, comonomers with anionic groups, for example olefinically unsaturated carboxylic acids such as acrylic acid or methacrylic acid, or olefinically unsaturated sulfonic acids, optionally in addition to conventional comonomers such as acrylamides, acrylic esters, methacrylic esters, vinyl esters, vinyl chloride and the like. In certain circumstances, the carboxyl groups present in the polyacrylonitrile as a result of hydrolysis of a small proportion of the nitrile groups suffices.

Examples of basic dyes are dyes of the diarylmethane and triarylmethane series, of the indolylarylmethane and diindolylarylmethane series, oxazine, thiazine, diazine, thiazole, xanthene, acridine, quinoline, quinophthalone, indoline and cyanine dyes, and basic azo and azomethine dyes.

Dyes of this nature are described, for example, in American Dye. stuff Reporter (1954), p. 432 – 433, in U.S. Pat. No. 2,716,655 and in British Patents No. 785,988 and 791,932, and in particular in the Color Index under the heading "Basic Dyes".

The compounds according to the invention have the following advantages over previously disclosed retarders for dyeing polyacrylonitrile fibers:

1. As they are more active, they can be used in smaller amounts than the previously used retarders, to produce equally level dyeings.

2. Since the concentration of cationic levelling agents which has be used is low, there is no risk of blocking the fibers, that is to say no risk that, for example, a dye added subsequently for shading will no longer be taken up by the fibers within the conventional dyeing time.

This risk does exist with conventional types of retarders such as lauryl-dimethyl-benzyl-ammonium chloride.

The percentages in the Examples which follow are based on the weight of the goods being dyed. The parts are parts by weight.

EXAMPLE 1

2,4,6-tris-(β-dimethyl-2-ethylhexyl-ammoniumethylamino)-triozine trichloride A mixture of 387 parts of ethyleneimine and 4,500 parts of dimethyl-2-ethylhexylamine is added to 554 parts of cyanuric chloride, dissolved in 1,200 parts of tetrahydrofuran at from 0° to 10°C and the mixture is then boiled under reflux, in nitrogen, for 2 ½ hours. The solvent, and a part of the dimethyl-2-ethylhexylamine are distilled from the reaction solution in vacuo and the residue is treated with excess ethyl acetate (to remove residual amine). The colorless product obtained is water-soluble and has the following composition:

Found: C: 58.8%, H: 11.1%, N: 15.9%, Cl: 13.2%.
Calculated: C: 59.7 H: 10.7 N: 16.1 Cl: 13.6.

Dyeing instructions 10 parts of anionically modified polyacrylonitrile high bulk yarn are dyed, at a constant temperature of 95°C, in 600 parts of a dyebath which contains 0.25%, based on the yarn, of the cationic dye of the formula

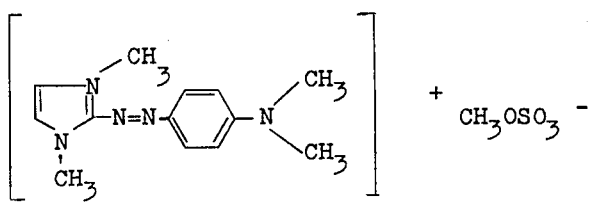

0.1 part of glacial acetic acid, 0.02 part of sodium acetate and varying amounts of retarder. In each series of experiments, the amount of retarder which lengthens the dye uptake time to 60 minutes under the stated conditions is determined. The uptake time is defined as the time in which 98% of the dye are taken up. The dye remaining in the liquor is determined colorimetrically.

In the present instance (Example 1), the amount of retarder as defined above is 0.022 part.

The retarder of the formula

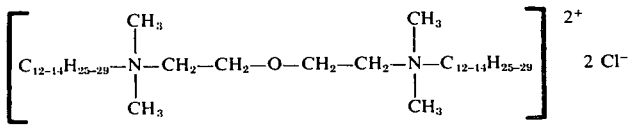

described in German Patent 1,092,878 is used for comparison. On following the dyeing instructions in Example 1, 0.03 part of this compound, which is regarded as particularly active, is required.

EXAMPLE 2

2,4,6-tris-(3-dimethylaminopropylamino)-triazine 369 parts of cyanuric chloride are introduced into 2,500 parts of benzene and 612 parts of 3-diemethylaminopropylamine, dissolved in 1,000 parts of benzene, are added dropwise in 2 ½ hours at from 10° to 20°C. The reaction is slightly exothermic. Finally, the mixture is stirred for one hour at 60°C and cooled and the hydrochloride which has precipitated is filtered off and dried. The yield of hydrochloride is 1,257 parts and the material contains 15.7% of chlorine. The hydrochloride is suspended in approx. 4,000 parts of n-butanol, 262 parts of sodium hydroxide are added and the mixture is stirred at room temperature until the entire sodium hydroxide has dissolved, which requires approx. 15 hours. The sodium chloride is filtered off, the filtrate is dried with sodium sulfate and the solvent is stripped off, using a waterpump. The triazine derivative, obtained in a yield of 87%, is in the form of a yellow viscous mass with a titer (in glacial acetic acid) of 8.1 ml of 1N $HClO_4$ per gram of substance (calculated: 7.88).

Bis-ammonium chloride 41 parts of the 2,4,6-tris-(3-dimethylaminopropylamino)-triazine obtained as described above, in 84 parts of dimethylformamide, are stirred with 42.8 parts of lauryl chloride for 15 hours at from 130° to 140°C, under a nitrogen atmosphere. The mixture is then diluted with 155 parts of water to approx. 25% solids content, giving a homogeneous light-brown liquid which can readily be diluted with water and can be employed directly as a dyeing assistant.

0.008 part of the product, i.e. 0.032 part of the 25% strength solution, are required for dyeing under the conditions defined in the dyeing instructions in Example 1.

EXAMPLE 3

If 2,4,6-tris-(3-dimethylaminopropylamino)-triazine is reacted, analogously to Example 2, with 2.8 moles of dodecyl chloride instead of 2 moles of lauryl chloride, and the product obtained is used as a dyeing assistant in accordance with the dyeing instructions in Example 1, 0.006 part of the product is required.

EXAMPLE 4

The reaction product of one mole of 2,4,6,-tris-(3-dimethylaminopropylamino)-triazine with 3 moles of benzyl chloride, obtained analogously to Example 2, is used in accordance with the dyeing instructions in Example 1. 0.007 part of the product is required.

EXAMPLE 5

0.013 part of the reaction product of 1 mole of 2,4,6-tris-(3-dimethylaminopropylamino)-triazine with 1 mole of $C_{16}$-$C_{18}$-alkyl chloride is required when used in accordance with the dyeing instructio ns in Example 1.

EXAMPLE 6

Likewise, 0.013 part of the reaction product of one mole of 2,4,6-tris-(3-dimethylaminopropylamino)-triazine with 2 moles of $C_{16}$--alkyl chloride is required when used in accordance with the dyeing instructions in Example 1.

EXAMPLE 7

0.014 part of the reaction product of 2,4,6-tris-(3-dimethylaminopropylamino)-triazine with 2 moles of benzyl chloride (analogous to Example 4) is required when used in accordance with the dyeing instructions in Example 1.

EXAMPLE 8

If 2.8 moles of benzyl chloride are used in place of 2 moles, analogously to Example 7, 0.008 part of the resulting ammonium chloride is required when used in accordance with the dyeing instructions in Example 1.

EXAMPLE 9

0.012 part of the reaction product of 1 mole of 2,4,6-tris-(3-dimethylaminopropylamino)-triazine with 2 moles of p-chlorobenzyl chloride is required when used in accordance with the dyeing instructions in Example 1.

EXAMPLE 10

If 2.8 moles of p-chlorobenzyl chloride are used analogously to Example 9 in place of 2 moles, 0.013 part of the product are required when used in accordance with the dyeing instructions in Example 1.

We claim:

1. A compound of the formula:

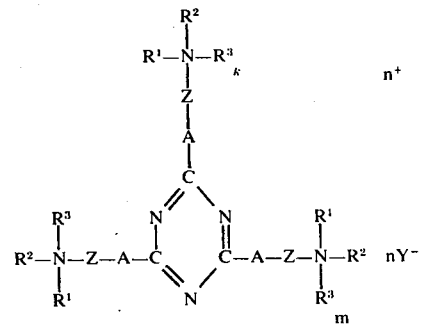

(I)

wherein A is an oxygen atom or a group of the formula RN< in which R is hydrogen or alkyl of 1 to 4 carbon atoms, $R^1$, $R^2$ and $R^3$ are, each independently straight-chain or branched optionally hydroxysubstituted alkyl of 1 to 30 carbon atoms optionally interrupted by oxygen or nitrogen or benzyl or chlorobenzyl or $R^1$ and $R^2$ together form alkylene of 4 to 6 carbon atoms, *k* and *m* are, each independently, zero or 1, Z is optionally hydroxy- or methyl-substituted alkylene of 2 to 6 carbon atoms optionally interrupted by oxygen, $Y^-$ is a monovalent organic or inorganic anion or is the *x*-th part of a x-valent organic or inorganic anion, *n* equals the sum of $1 + k + m$, provided that the total number of carbon atoms in $R^1$, $R^2$ and $R^3$ is from 9 to 60 and the total number of carbon atoms in $R^1$, $R^2$ and $R^3$ of at least one ammonium group is not less than 5.

2. A salt as claimed in claim 1 in which $X^{(-)}$ is a bromide, chloride or methosulfate anion.

3. A compound as claimed in claim 1 wherein Z is ethylene, propylene or hydroxypentamethylene, A is —NH— and $R^1$, $R^2$ and $R^3$ each are alkyl having 1 – 30 carbon atoms.

4. A compound as claimed in claim 1 wherein Z is 1,2-ethylene, 1,2-propylene or 1,3-propylene.

5. A compound as claimed in claim 1 wherein $R^1$ and $R^2$ independently are alkyl of 1 – 4 carbon atoms, and $R^3$ is alkyl of 10 – 18 carbon atoms.

6. A compound as claimed in claim 1 wherein $R^1$ and $R^2$ are each methyl, $R^3$ is 2-ethylhexyl, Z is ethylene, and A is —NH—.

7. A compound as claimed in claim 1 wherein $R^1$ and $R^2$ each are methyl, $R^3$ is lauryl, Z is propylene and A is —NH—.

8. A compound as claimed in claim 1 wherein $R^1$ and $R^2$ each are methyl, $R^3$ is dodecyl, Z is propylene and A is —NH—.

9. A compound as claimed in claim 1 wherein $R^1$ and $R^2$ each are methyl, $R^3$ is benzyl, Z is propylene and A is —NH—.

10. A compound as claimed in claim 1 wherein $R^1$ and $R^2$ each are methyl, $R^3$ is $C_{16-18}$ alkyl, Z is propylene and A is —NH—.

11. A compound as claimed in claim 1 wherein $R^1$ and $R^2$ each are methyl, $R^3$ is p-chlorobenzyl, Z is propylene and A is —NH—.

* * * * *